US005517384A

United States Patent [19]

Hahne et al.

[11] Patent Number: 5,517,384

[45] Date of Patent: May 14, 1996

[54] COMPOUND SURFACE-CHARGING ELECTRODE

[75] Inventors: Ernst A. Hahne, Allschwil, Switzerland; Franz Knopf, Bühl/Stadt, Germany

[73] Assignee: Eltex-Elektrostatak GmbH, Well am Rhein, Germany

[21] Appl. No.: 331,496

[22] PCT Filed: Feb. 20, 1994

[86] PCT No.: PCT/EP94/00487

§ 371 Date: Oct. 28, 1994

§ 102(e) Date: Oct. 28, 1994

[87] PCT Pub. No.: WO94/24737

PCT Pub. Date: Oct. 27, 1994

[30] Foreign Application Priority Data

Apr. 16, 1993 [DE] Germany ..... 43 12 483.6

[51] Int. Cl.[6] ..... H01T 19/04

[52] U.S. Cl. ..... 361/230

[58] Field of Search ..... 361/212, 213, 361/214, 220, 221, 222, 225, 229, 230, 231; 250/324, 326; 355/221, 224

[56] References Cited

U.S. PATENT DOCUMENTS

| | | | |
|---|---|---|---|
| 3,334,227 | 8/1967 | Cipriani | 250/324 |
| 3,397,136 | 8/1968 | Balogh | 361/233 x |
| 3,578,970 | 5/1971 | Michaud et al. | 361/225 X |
| 3,603,851 | 9/1971 | Metcalfe et al. | 361/229 |
| 3,890,504 | 6/1975 | Pendleton et al. | 361/225 X |
| 4,295,178 | 10/1981 | Spengler | 361/220 |
| 4,523,082 | 6/1985 | Sturdevant | 361/229 X |

FOREIGN PATENT DOCUMENTS

| | | | |
|---|---|---|---|
| 1589743 | 4/1970 | Germany | 361/222 |

*Primary Examiner*—Fritz M. Fleming
*Attorney, Agent, or Firm*—Max Fogiel

[57] ABSTRACT

A compound surface-charging electrode (6) with a metal housing (11). The housing accommodates two or more unit electrodes and upstream resistances (1) that can be connected to a source (U) of high voltage. The unit electrodes have prongs (3) that project out of the housing. The housing is open enough to allow them to do so. Each prong can be covered up by an electrically conductive electrode hatch (4). The electrode hatch is electrically conducting and connected to the housing. The housing and the electrode hatch are connected over to one terminal of a resistor, the other terminal of which can be grounded.

12 Claims, 1 Drawing Sheet

COMPOUND SURFACE-CHARGING ELECTRODE

BACKGROUND OF THE INVENTION

Many types of single-unit surface-charging electrode are known (German B 3 522 881). The prongs of such electrodes are very often electrically decoupled by way of upstream resistances in the generator power-supply circuitry. When several such prongs are aligned along a strip, charges can he applied in high-speed printing machinery several meters wide. The resulting electric-field forces are employed to attach surfaces to metal cylinders or to block out multiple-layer surfaces.

Machinery of this type often handles surfaces of different width. When an electrode charges a blank metal-cylinder surface with a corona current, the surface is altered or destroyed. When the charge occurs between two electrodes, impermissibly high currents will flow where there is no surface.

It is for this reason that on-and-off single-unit surface-charging electrodes (German 2 948 902) were developed. Various widths can be accommodated by switching them on and off by hydraulic or pneumatic fluid conveyed to each electrode over fluid-tight lines.

On-and-off electrodes occupy considerable space even without the associated hydraulic and pneumatic systems, and the overall result is a comparatively bulky high-voltage electrode. Also unacceptable in explosion-hazardous areas are the sparks that accompany switching operations, not to mention the discharge sections, creep currents, etc. that occur even while the electrodes are off.

Varying the operating width with electrode hatches made of an insulating material and sliding back and forth over unit electrodes that do not switch on and off is also known. There is a drawback, however, in that the electrodes' prongs will continue to emit charges, which will seek thoroughfare to a matching countervailing potential.

Finally, turning groups of unit electrodes in a compound surface-charging electrode on and off is also known (German 3 725 142).

A drawback to this approach is that one control line and one line to the high-voltage source is needed for each group of electrodes. Furthermore, automatically controlling the groups is complicated.

SUMMARY OF THE INVENTION

The object of the present invention is accordingly a simple improvement in the generic compound surface-charging electrode that will allow as many component unit electrodes as desired to be activated or deactivated.

If for example the unit electrodes are cast along with their prongs in a metal housing that is open along one side and if such a compound electrode is insulated from the housing, the surface of the housing will be charged by electrostatic induction while the machinery is in operation. If such a housing is coated with insulation, the electrodes will function exactly as they would in a housing of insulating plastic.

The prongs of the unit electrodes, projecting out along the open side of such a metal housing, can simultaneously be rendered almost non-conducting by means of metallically conducting sliding electrode hatches, preferably metal, if those prongs can be rendered almost non-conducting by the electrode hatch, which is provided along with the housing with high-impedance grounding, if those prongs that are not supposed to keep on emitting can be blocked by an electrode hatch that does not come into contact with them.

When the electrode hatch system is electrically conductive and arrives in front of the emitting prong of a unit electrode, the area of its surface facing the prong will assume more or less the same potential as the prong. The field around the prong will accordingly become weak enough for the emitted current to decrease almost to zero. It has also surprisingly been discovered that the emitted current increases linearly with the number of unprotected prongs.

BRIEF DESCRIPTION OF THE DRAWINGS

One embodiment of the invention will now be specified with reference to the accompanying drawing, wherein.

DESCRIPTION OF THE PREFERRED EMBODIMENTS

Figure 1:
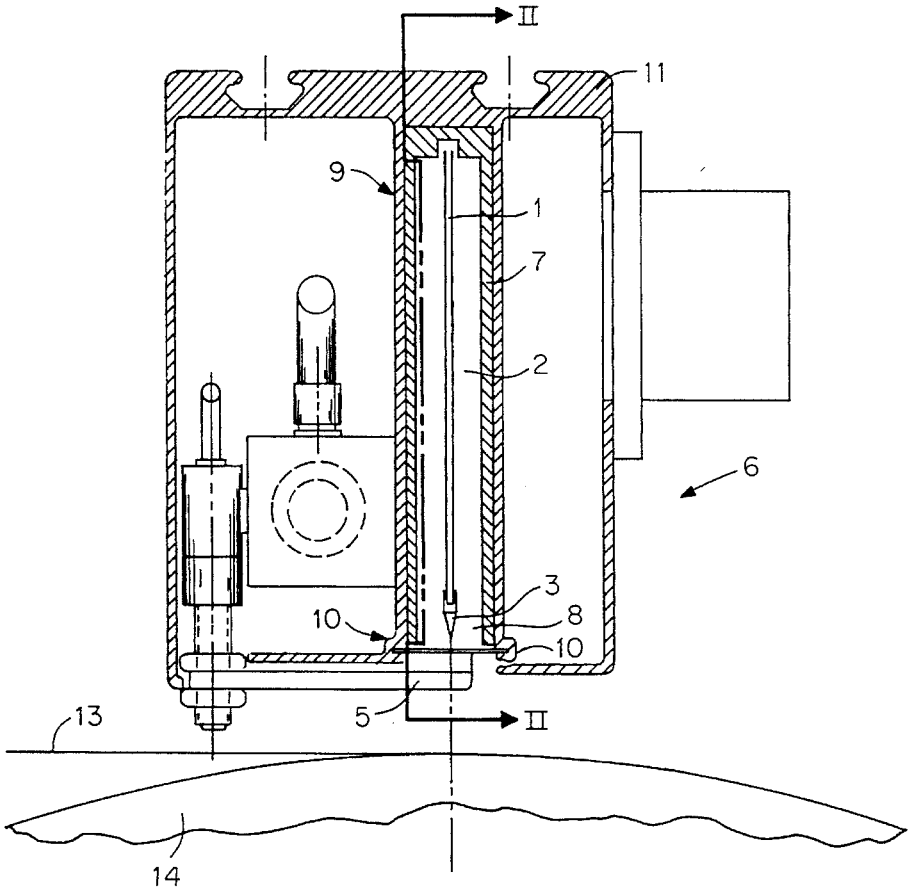
FIG. 1 is a schematic cross-section through a surface-charging electrode and FIG. 2 is a schematic side view of the electrode.

A surface-charging compound electrode 6 includes a metal housing 11. Housing 11 accommodates several unit electrodes. The electrodes have prongs 3 and can be connected to a source of high-voltage electricity by way of upstream resistance 1. Resistance 1 is embedded in an insulating resin 2. Prongs 3 extend out of resin 2.

Prongs 3 are suspended above a web 13 of paper that travels over a drum 14. Cylinder 14 is maintained cool.

The unit electrodes are accommodated along with prongs 3, resistance 1, and resin 2 in a separate electrode housing 7. Housing 7 is electrically conductive and preferably metal. The housing is right parallelepipedal and has one side 8, the side facing down in the drawing, open to allow prongs 3 to emerge. The outer surface of housing 7 is insulated. The overall housing fits into a matching accommodation 9 in housing 11.

Figure 2:
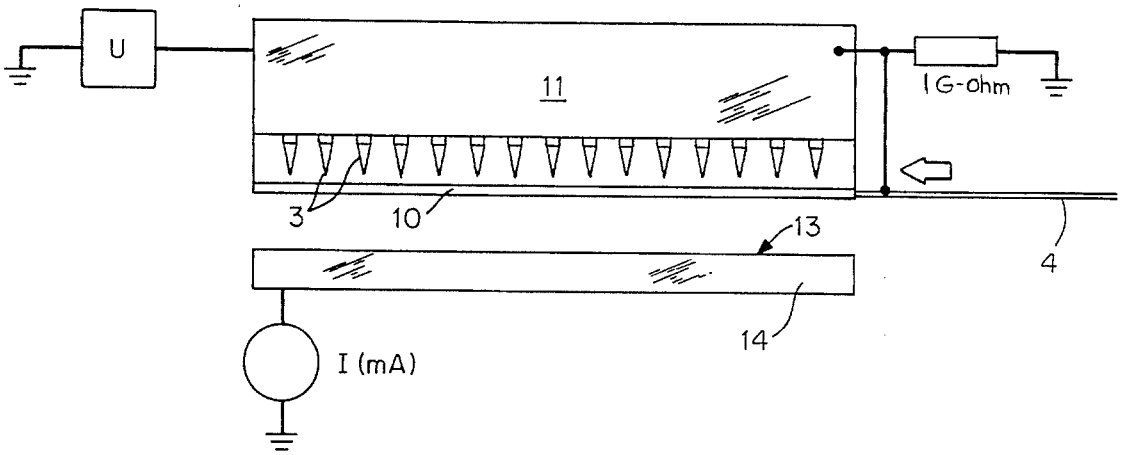

At the bottom of the right-parallelepipedal accommodation 9 in housing 11 are grooves 10. Grooves 10 accept an electrode hatch 4 in the form of a metal slide. The slide in the illustrated embodiment slides back and forth in grooves 10 subject to a carrier 5 and controlled by a pneumatic cylinder, covering and uncovering electrode prongs 3 as desired and as illustrated schematically in FIG. 2. The housing and slide are well connected electrically. Both components are grounded by way of an approximately 1 G-ohm resistor. The source of high voltage is labeled "U" in FIG. 2.

We claim:

1. A compound surface-charging electrode comprising a metal housing; a source of high voltage; at least two unit electrodes and upstream resistances connected to said source of high voltage; said unit electrodes having prongs projecting out of said housing, said housing having an opening for allowing said prongs to project out of said housing; an electrically conductive electrode hatch for covering each of said prongs, said electrode hatch being electrically conducting and connected to said housing; a resistor with two terminals; said housing and said electrode hatch being connected to one of said terminals, the other one of said terminals being connected to ground potential.

2. An electrode as defined in claim 1, wherein said hatch comprises metal.

3. An electrode as defined in claim 1, wherein said hatch comprises a slide.

4. An electrode as defined in claim 3, wherein said slide slides back and forth in two grooves in said housing.

5. An electrode as defined in claim 4, wherein said housing has a right-parallelepipedal receptacle and an open side, said two grooves being adjacent said open slide.

6. An electrode as defined in claim 1, including an additional housing, a unit electrode being embedded in said additional housing.

7. An electrode as defined in claim 1, including an additional housing; all said unit electrodes being in said additional housing.

8. An electrode as defined in claim 7, wherein said additional housing is electrically conductive.

9. An electrode as defined in claim 7, wherein said additional housing has insulation over an outer surface of said additional housing.

10. An electrode as defined in claim 7, wherein said first-mentioned housing has a right-parallelepipedal receptacle for receiving said additional housing.

11. An electrode as defined in claim 8, wherein said additional housing comprises metal.

12. An electrode as defined in claim 1, wherein said housing is a right parallelepipedal having one open side for said prongs to project out of.

* * * * *